US007070440B1

(12) United States Patent
Zerebilov et al.

(10) Patent No.: US 7,070,440 B1
(45) Date of Patent: Jul. 4, 2006

(54) COAXIAL CABLE INSULATION DISPLACEMENT CONNECTOR

(75) Inventors: Arkady Y. Zerebilov, Lancaster, PA (US); Christopher W. Shelly, Hummelstown, PA (US); Yoshihiro Fukase, Middletown, PA (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/143,477

(22) Filed: Jun. 3, 2005

(51) Int. Cl.
*H01R 9/05* (2006.01)

(52) U.S. Cl. ..... 439/394; 439/582

(58) Field of Classification Search ..... 439/394, 439/582

See application file for complete search history.

(56) References Cited

U.S. PATENT DOCUMENTS

| | | | | |
|---|---|---|---|---|
| 4,533,191 | A | 8/1985 | Blackwood | |
| 4,632,486 | A | 12/1986 | Hasircoglu | |
| 4,708,414 | A | 11/1987 | Lam | |
| 5,011,428 | A | 4/1991 | Heng et al. | |
| 5,037,329 | A * | 8/1991 | Wright | 439/582 |
| 5,314,349 | A | 5/1994 | Czeschka et al. | |
| 5,494,454 | A * | 2/1996 | Johnsen | 439/394 |
| 6,648,684 | B1 * | 11/2003 | Tang | 439/582 |
| 6,692,286 | B1 * | 2/2004 | De Cet | 439/352 |
| 6,712,645 | B1 * | 3/2004 | Chou | 439/582 |
| 6,860,761 | B1 * | 3/2005 | Lee et al. | 439/582 |

* cited by examiner

*Primary Examiner*—Gary F. Paumen
(74) *Attorney, Agent, or Firm*—Daniel R. Edelbrock

(57) ABSTRACT

A right-angle coaxial cable connector has an inner cable stop for positioning an end of a coaxial cable in a specific location within an electrically conductive connector housing. A terminal device of the connector includes a center contact terminal with insulation displacement blades on one end. A dielectric member is sandwiched between the center contact terminal and an outer electrical contact. The cable stop surface may be a direct projection from the housing or an extension of the dielectric member. The projection or dielectric member electrically isolates a conductive core of the cable from the connector housing. Full insertion of the terminal device or a part of the terminal device into the connector housing causes the blades to cut through insulation of the cable and electrically connect the conductive core of the cable with the center contact terminal. The structure of the connector housing and the assembly process enable inspection of the cable end location within the housing prior to termination of the cable. A ferrule is used to secure the cable to the housing after confirmation of the location. The outer electrical contact of the terminal device is electrically connected to an outer conductive sheath of the cable through the connector housing when the ferrule is crimped on the housing around the sheath.

15 Claims, 11 Drawing Sheets

COAXIAL CABLE INSULATION DISPLACEMENT CONNECTOR

BACKGROUND OF THE INVENTION

1. Field of the Invention

The invention is directed in general to an angled coaxial cable connector and more specifically to such a connector that makes use of an insulation displacement termination method to minimize assembly time and connector size.

2. Discussion of Related Art

Coaxial cable connectors often have a right-angle, or some other angle, design to facilitate electrical engagement with connection ports or printed circuit boards. This can eliminate the need to significantly bend the cable, and thereby possibly damage the connection between the connector and cable, when making the electrical engagement. Typical right-angle coaxial cable connectors use traditional methods of terminating the cable in the connector such as soldering and crimping. Both have advantages and disadvantages. In the soldering method, the size of the connector can be relatively small because the cable is brought in perpendicular to an axis of the interface between two contact sections. However, this procedure is time consuming and often hazardous. The crimping method is faster and non-hazardous in comparison to the soldering method. There are two types of crimp configurations. One requires two contacts, resulting in increased component count. The other requires only one contact, but the cable has to be bent, so this method requires a longer connector length due to the bend radius of the cable.

One way of doing away with the need for two separate terminals crimped or soldered together to provide the right angle turn within the connector is disclosed in co-pending U.S. patent application Ser. No. 11/016,919, filed Dec. 21, 2004. A connector assembly has first and second main components. A terminal crimped on an end of a coaxial cable is inserted through the second component and secured in the first component when the two components are in a straight or in-line configuration. The cable is secured to the second component. Then the second component is rotated relative to the first component to bend the cable and transform the assembly into a right-angle connector.

U.S. Pat. No. 4,632,486 provides an example of how insulation displacement terminals have been used in coaxial cable connectors. A ribbon-type coaxial cable has its outer jacket and each conductive sheath stripped back from the inner insulation layer and signal wire. The cable is inserted into and secured by adhesive within a first housing part of insulating material. A second, separate housing part also made of insulating material contains female terminals having insulation displacement contact portions at one end. The insulation displacement contact portions protrude from the second housing part. When the two housing parts are guided together the insulation displacement contact portions cut through the inner insulation layers to contact the signal wires and electrically connect the signal wires with the female terminals. While the method disclosed in this patent may provide a solution for terminating ribbon-type coaxial cables, it requires a large, two-piece connector and does not address problems associated with connectors requiring center contact terminals with concentric outer terminal sockets. A smaller size, lower component count connector with a fast termination method would provide a significant improvement to these existing types of connectors.

SUMMARY OF THE INVENTION

Accordingly, it is an object of this invention to provide a right-angle coaxial cable connector that is as small as a contact interface and cable size will allow.

Another object of the invention is to eliminate the need for soldering and crimping methods for terminating the inner conductor of the cable.

A further object of the invention is to minimize the number of connector components while incorporating a fast termination method.

In carrying out this invention in the illustrative embodiment thereof, an electrically conductive, one-piece connector housing has a first, main cylindrical section for receiving a terminal device and a second, barrel section for receiving an end of a coaxial cable. The sections have intersecting interiors. The coaxial cable end is stripped to expose the inner insulation layer and a cut-back part of the outer conductive sheath is flared outward. The stripped end of the cable is inserted through the barrel section into the first section. A cable stop positions the cable end in a specific, proper location for electrical connection with the terminal device. This location can be visually confirmed by looking into the first section. Then a ferrule is used to crimp the flared sheath around the barrel section, securing the cable to the connector housing.

The cable stop can be provided by a projection within the first housing section against which the insulating layer of the cable end abuts. The projection creates a space between an inner conductive core or signal wire of the cable end and the conductive housing, electrically separating the core of the cable from the housing. Alternatively, the cable stop can be provided as an extension of a dielectric member associated with the terminal device.

The terminal device comprises an inner contact terminal having a female terminal part at one end and insulation displacement blades at an opposite end. The inner terminal is held within the dielectric member. An outer socket or contact is fit around the dielectric member. In one possible assembly process, the inner terminal, dielectric member and outer contact are secured together in fixed position. Press-fitting the outer contact into the first section of the connector housing causes the insulation blades on the inner terminal to cut through the insulation layer of the cable and physically and electrically contact the core.

In another possible assembly process, the dielectric member with the extension for providing a cable stop is press-fit into the first housing section before insertion of the cable end. The inner terminal is movable within the dielectric member, and after the cable end is positioned in the correct location the inner terminal with the insulation displacement blades is forced into electrical contact with the cable core. The outer contact is separately press-fit into the first housing section, either after the electrical connection is made or simultaneously with a single tool stroke acting on both the outer contact and inner terminal.

The invention enables the size of the connector to be reduced. It allows use of an insulation displacement termination method for faster termination of coaxial cables. There is a reduction in the number of components and the assembly process can be automated. These advantages combine to result in a low-cost and easier to assemble connector.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENTS

Figure 1:
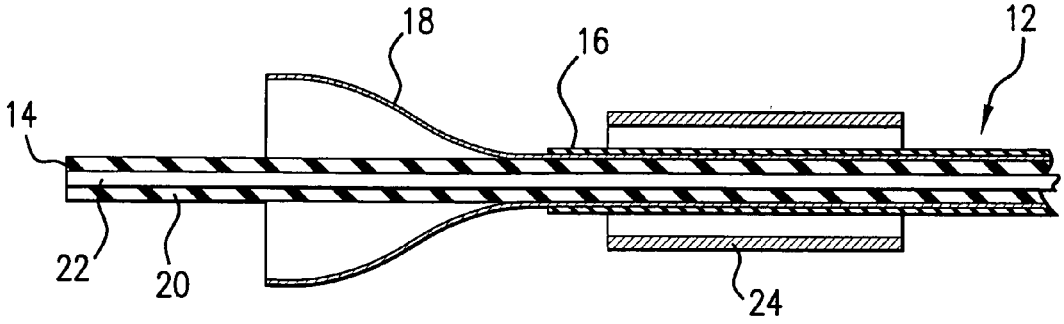
FIG. 1 illustrates how a coaxial cable end is prepared for assembly with a connector according to the present invention.

Referring now to FIG. 1, a coaxial cable 12 has an end 14 prepared for termination to a right angle coaxial cable connector according to the current invention. An outer insulative jacket 16 of the cable is stripped back a predetermined distance and then an outer conductive sheath or braid 18 is exposed and cut back a second, specific distance from the end 14. An inner insulation layer 20 and center conductive core 22 are left undisturbed. A ferrule 24, fashioned from a ductile, electrically conductive material such as brass, is slid over the cable end to surround the outer jacket 16 adjacent the cable end. Then the braid 18 is flared outward.

Figure 2:
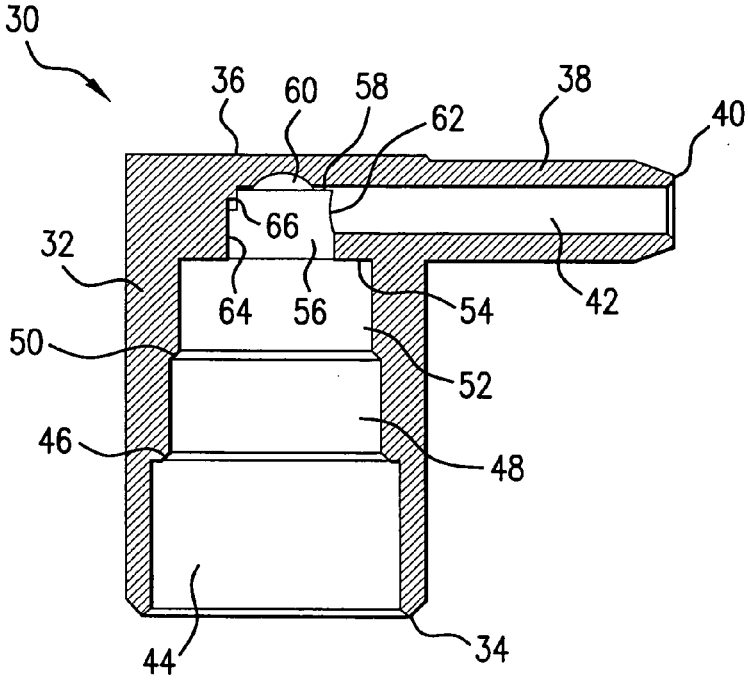
FIG. 2 is an enlarged cross-sectional side view of a coaxial cable connector housing according to the present invention.

A connector body or housing 30 according to the present invention is shown in FIG. 2. The housing may be die-cast from an electrically conductive metal or material such as zinc or a zinc-aluminum alloy. The connector housing 30 has a generally hollow, cylindrical, first main section 32 with a first, open, terminal mating end 34 and a second, cable receiving end 36. A relatively smaller second, barrel section 38 extends at an angle from the main section 32 adjacent the cable receiving end 36. The angle is depicted as being a right angle, but could be a different angle depending on the requirements of the connector environment. The barrel section 38 tapers to a free end 40 distal from the main section 32. The barrel section has a central, internal passage 42 leading to an interior of the main section.

The interior of the main section 32 comprises a series of chambers decreasing in internal diameter from the terminal mating end 34 to adjacent the cable receiving end 36. A first chamber 44 extends from the terminal mating end 34 back partially along the main section to an inclined step or ledge 46. A second chamber 48 stretches along the main section from the first chamber to an inclined step 50. A third chamber 52 extends from the step 50 along the main section to a first radial wall 54. A fourth chamber 56 continues back along the main section to a second radial wall 58. A dome-shaped depression 60 is formed in the radial wall 58 adjacent the second end of the main section 32.

The fourth chamber 56 intersects with the internal passage 42 through the barrel section 38 of the housing 30 at an opening 62 in an annular wall 64 of the chamber. On an opposite side of the fourth chamber from the opening 62, there is a cable stop surface formed by a protruding projection 66 at the junction of the annular wall 64 and the radial wall 58.

Figure 3:
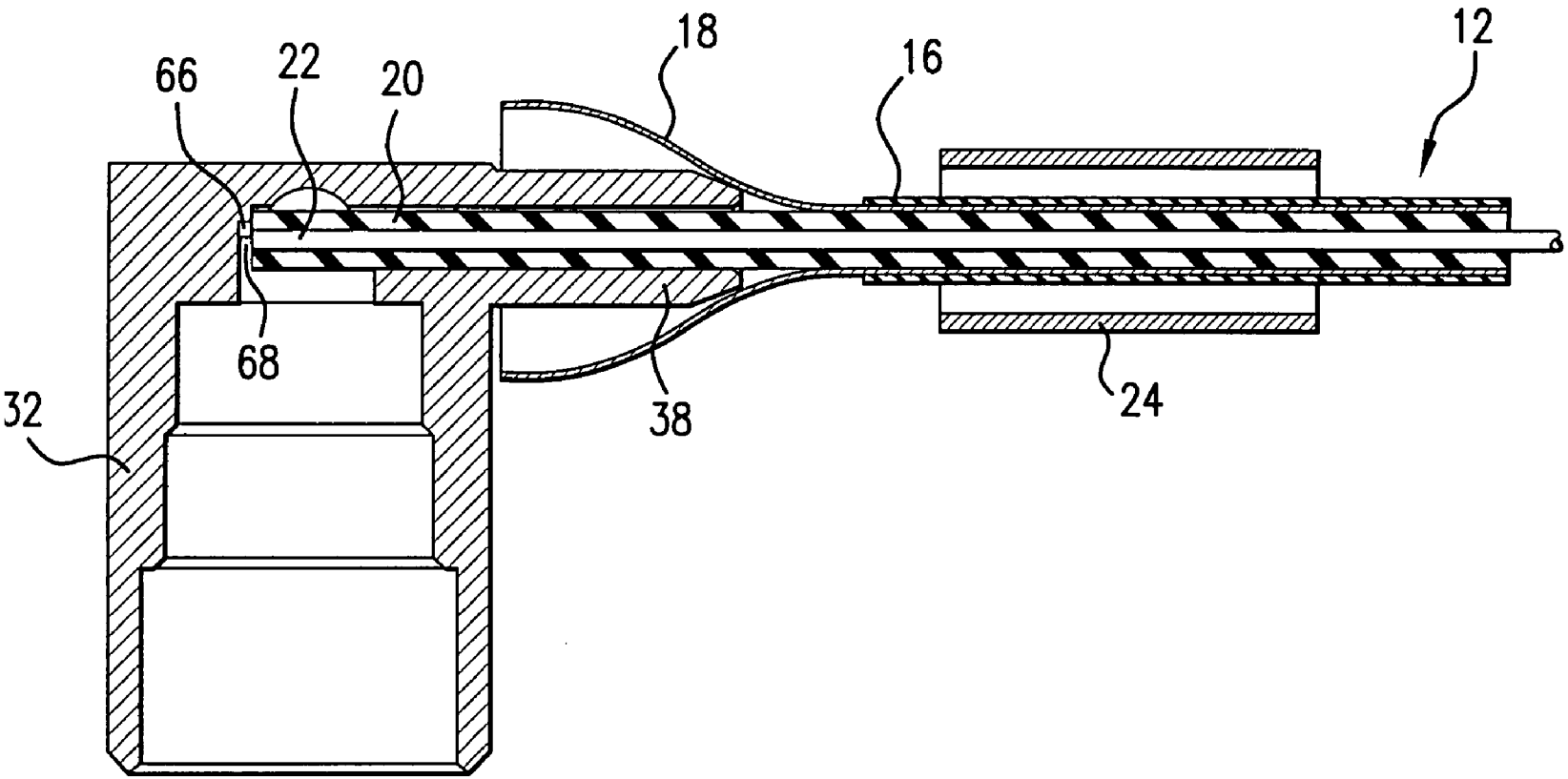
FIG. 3 is a cross-sectional side view of the connector housing with the coaxial cable end inserted therein.

The purpose or function of the projection 66 is depicted in FIG. 3. The internal diameter of the passage 42 through the barrel section 38 is sized to snugly receive the exposed inner insulation layer 20 of the coaxial cable end 14. The insulation layer at the end 14 engages the projection 66 as the flared conductive braid 18 wraps around the barrel section 38 and abuts against the main section 32 of the housing. The projection 66 acts as a cable stop, and provides a gap or space 68 between the conductive core 22 of the cable and the annular wall 64 of the fourth chamber 56. In other words, the projection 66 prevents electrical contact between the core 22 and the housing 30, guarding against electrical shorting of the core 22. The projection is aligned or in-line with the chambers and open end 34 of the first housing section. Therefore, an assembler can look through the chambers from the terminal mating end 34 to inspect the position of the cable and make sure the inner insulation layer is against the projection 66.

Figure 4:
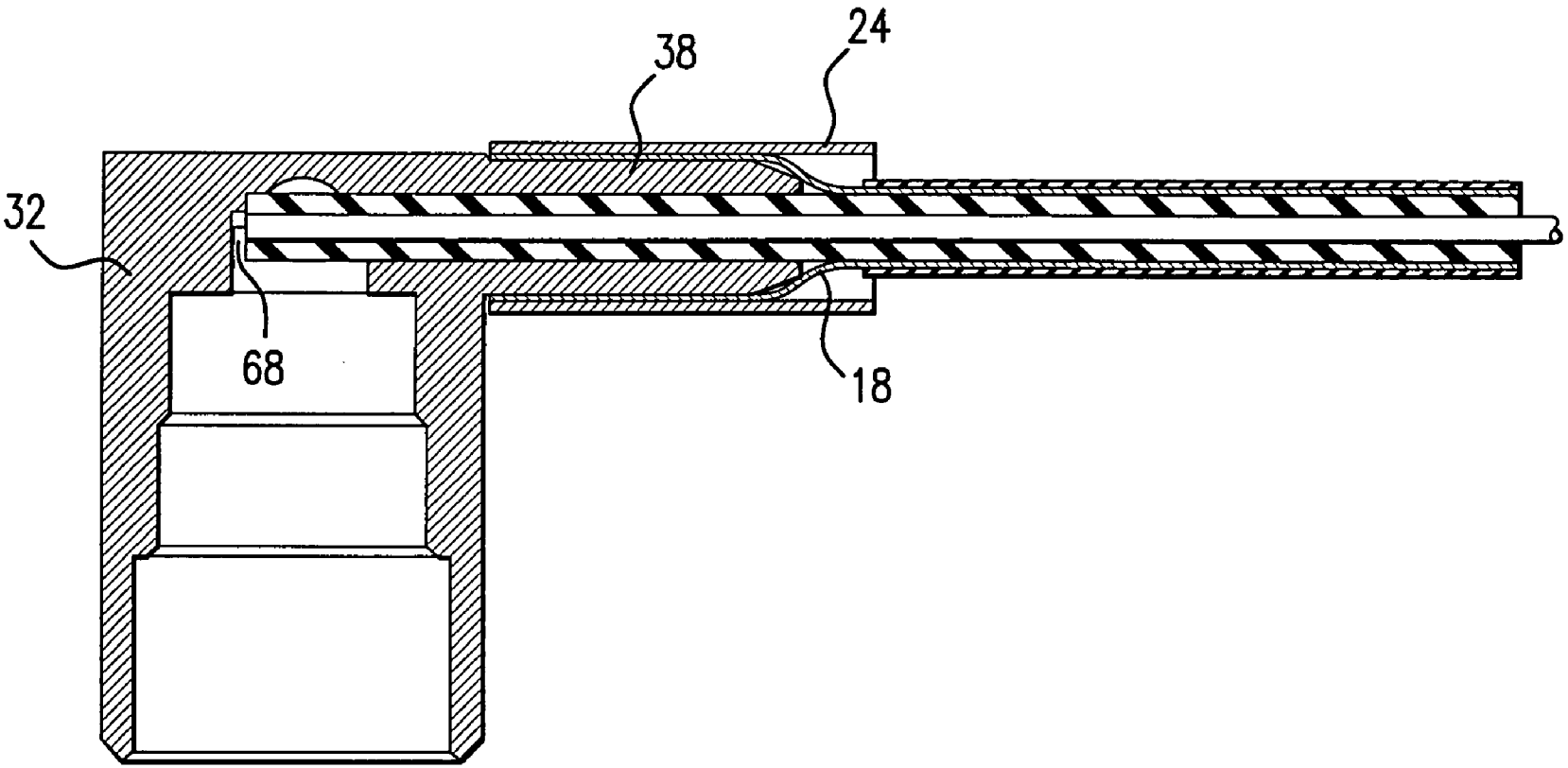
FIG. 4 is a cross-sectional side view of the connector housing illustrating how the cable end is secured to the housing.

As shown in FIG. 4, after the coaxial cable end is pressed against the projection 66, the ferrule 24 is slid over the braid 18 and connector housing barrel section 38 until it engages the main section 32 and captures the conductive braid between the ferrule and barrel section. The ferrule is then crimped around the braid and barrel section, ensuring good electrical contact between the braid and conductive connector housing 30. This secures the coaxial cable 12 to the connector housing 30 with the braid 18 in electrical contact with the housing and the core 22 of the cable electrically isolated from the housing by the air in space 68 within the chamber 56.

Figure 6:
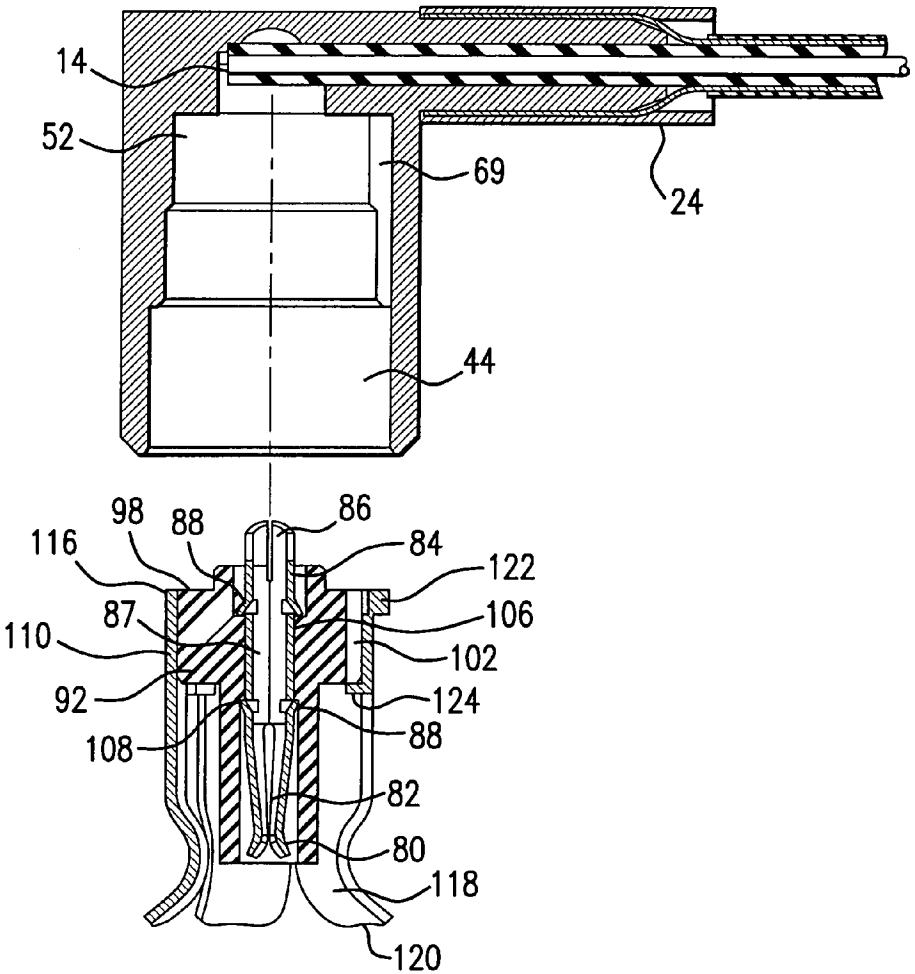
FIG. 6 is a cross-sectional side view of the housing with a corresponding, different cross-section of the terminal device prior to assembly.
Figure 5:
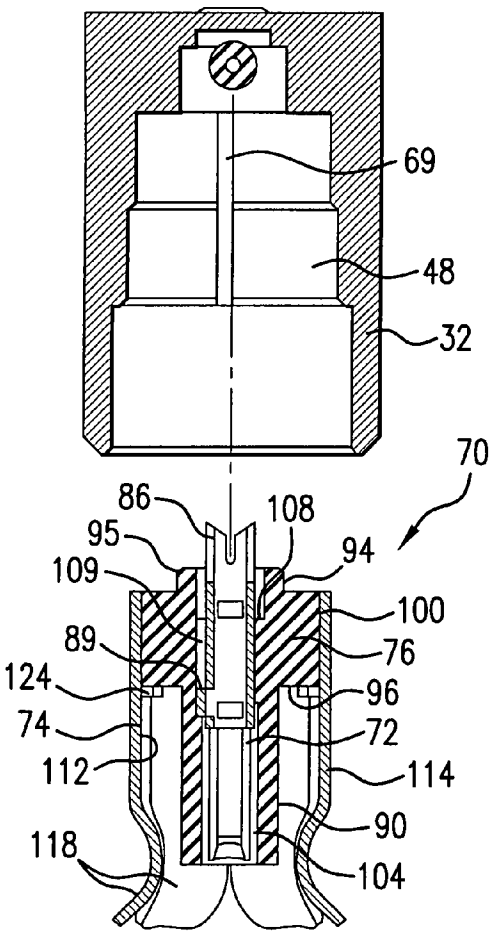
FIG. 5 is a cross-sectional end view of the connector housing and cable end in combination with a cross-section of a terminal device prior to assembly of the terminal device with the connector housing.

The different cross-section views of FIGS. 5 and 6 illustrate that the housing 30 includes a guide slot 69 extending along the inner walls of chambers 48 and 52. These Figures also illustrate a terminal device 70 prior to insertion into the main section 32 of the connector housing 30 and assembly with the housing and coaxial cable end 14. The terminal device 70 comprises an inner center contact terminal 72, an outer contact terminal 74, and a dielectric insert or member 76 sandwiched between the terminals and electrically isolating them from each other.

The inner center contact terminal 72 has a first end 80 in the form of a female terminal part 82 and a second part or end 84 comprising insulation displacement surfaces or blades 86. The terminal 72 is illustrated as being stamped or otherwise manufactured in one piece and is made from an electrically conductive metal such as brass or stainless steel. The female terminal part 82 could alternatively be formed as a male terminal, depending on the type of terminal the connector housing 30 is meant to mate with. A center part or portion 87 of the terminal 72 has longitudinally spaced sets of resilient retention barbs 88, one set at a forward end adjacent the female terminal part 82 and another set at a rearward end adjacent the blades 86, for securing the terminal in the dielectric member 76. The retention barbs are depicted as angled cut-outs from the center portion 87. The center portion 87 also includes an orientation projection 89 adjacent the barbs at the forward end.

The dielectric insert or member 76 may be made from a material such as Nylon, Teflon, polybutylene-terephalate or any of a variety of extruded plastics. It comprises a first cylindrical segment 90, a second cylindrical segment 92 larger in outer diameter but shorter in length than the first cylindrical segment, and a short lip or rim element 94 on the opposite side of the second segment 92 from the first segment 90. The rim element 94 has a rounded or beveled edge 95. A ledge 96 is formed where the first segment 90 joins the second segment 92, and a radial stop surface 98 is formed at the juncture of the rim element 94 and second segment 92. As best seen in FIG. 6, an outer surface 100 of the second segment 92 has a groove or channel 102 along its length.

The dielectric member 76 has a central passage 104 passing through it, with a narrower inner portion 106. Each end of the narrower portion 106 provides a stop surface 108 against which the retention barbs 88 of the center contact terminal 72 catch when the terminal 72 is pushed into the dielectric member. A slot 109 in an inner wall of the narrower passage portion 106 interacts with the orientation projection 89 on the center portion 87 of the terminal to orient and guide the terminal into the proper position. In the fully inserted, locked position, the female terminal part 82 extends through the first segment 90 of the dielectric member 76, the center portion 87 of the terminal is clamped by the retention barbs 88 within the narrower portion 106 of the passage through the member, and the insulation displacement blades 86 extend out of the rim segment 94 of the member.

The outer female socket or contact 74 is constructed to accept a standard male connector (not shown) for mating with the female terminal 72. Like the terminal 72, it may be stamped and bent or otherwise manufactured in one piece from a conductive metal such as brass or stainless steel. The contact 74 has a ring element 110 with an inner annular surface 112 and an outer surface 114. A first end 116 of the ring element is sized to receive the dielectric member 76. Spring fingers 118 extend from the ring element 110 for receiving the male connector through a second end 120.

The outer surface 114 of the ring element 110 adjacent the first end 116 has a short guide protuberance 122. The inner surface 112 of the ring element has a longitudinal rib (not shown in order to illustrate the channel 102 on the outer surface 100 of the second segment 92 of the dielectric member 76 in cross-section) and tabs 124 bent inward into an interior of the ring element. The tabs 124 are spaced from the first end 116 of the ring element 110 at a distance equal to the length of the second segment 92 of the dielectric member.

The dielectric member 76 (with the secured inner contact terminal 72) is inserted through the first end 116 of the outer contact 74. The channel 102 is aligned with the rib on the inner surface of the ring element 110 to orientate the insert and prevent rotation of the member relative to the outer contact. The outer surface 100 of the second segment 92 of the member is press-fit into the ring element until the ledge 96 abuts against the bent tabs 124.

Figure 8:
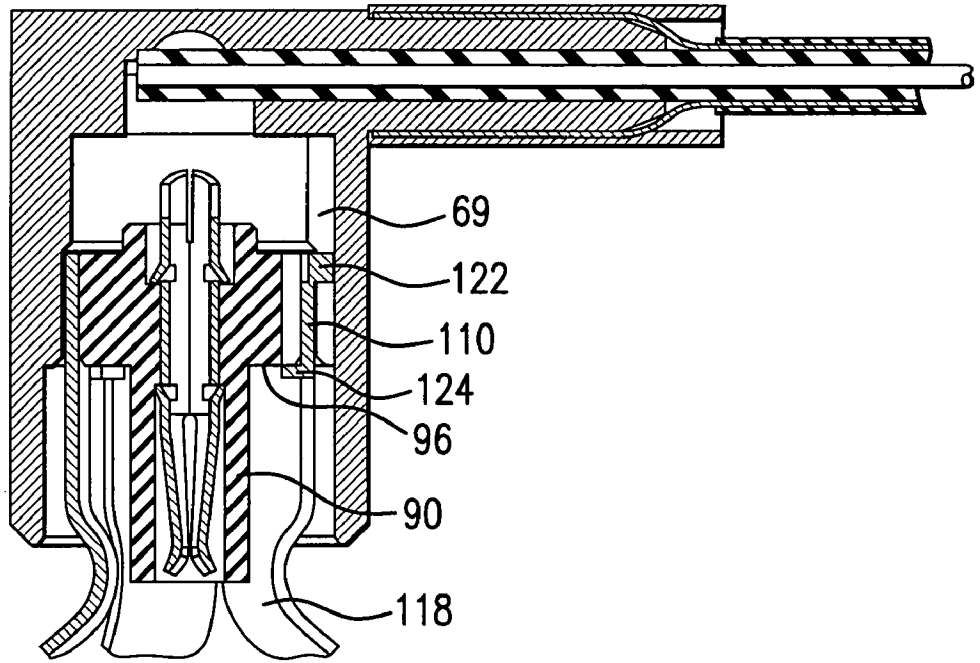
FIG. 8 is the same progression as FIG. 7 but taken from the same viewing angle of FIG. 6.
Figure 7:
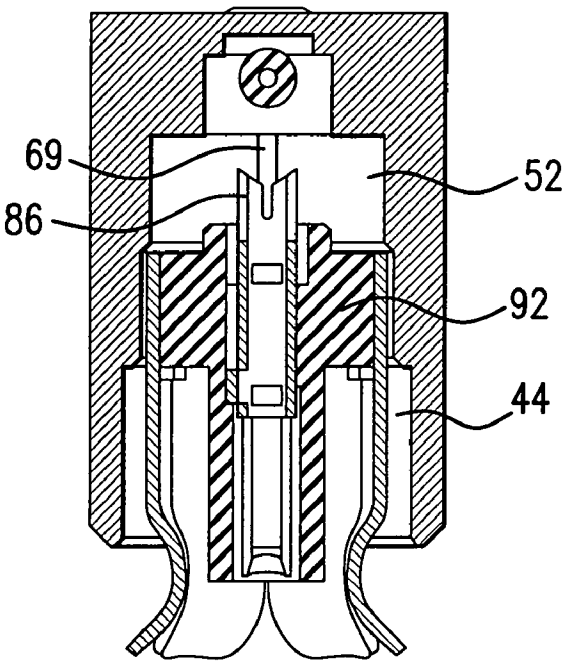
FIG. 7 is a progression from FIG. 5 illustrating partial insertion of the terminal device into the connector housing.
Figure 10:
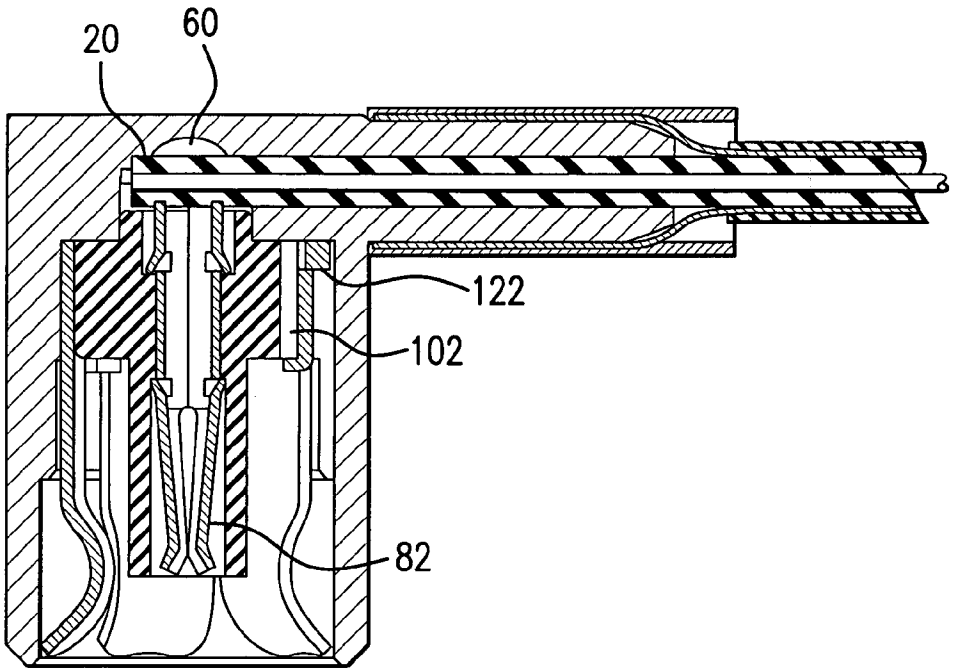
FIG. 10 is similar to FIG. 9 but taken from the side viewing angle of FIGS. 6 and 8.
Figure 9:
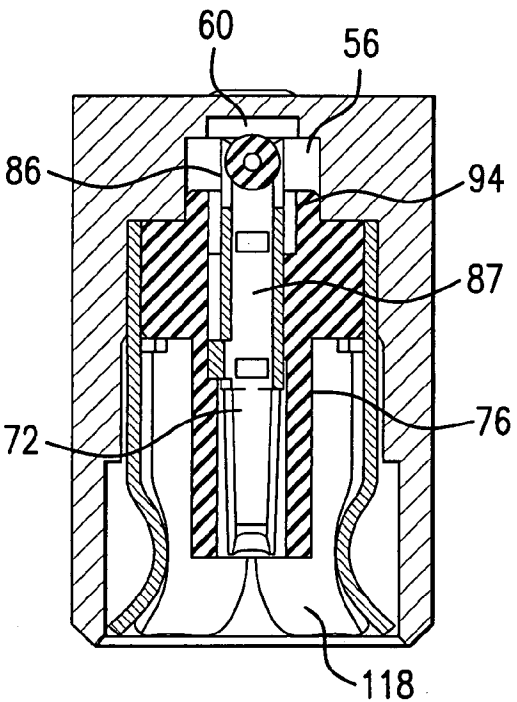
FIG. 9 illustrates a further progression from FIG. 7 into the fully assembled condition.
Figure 12:
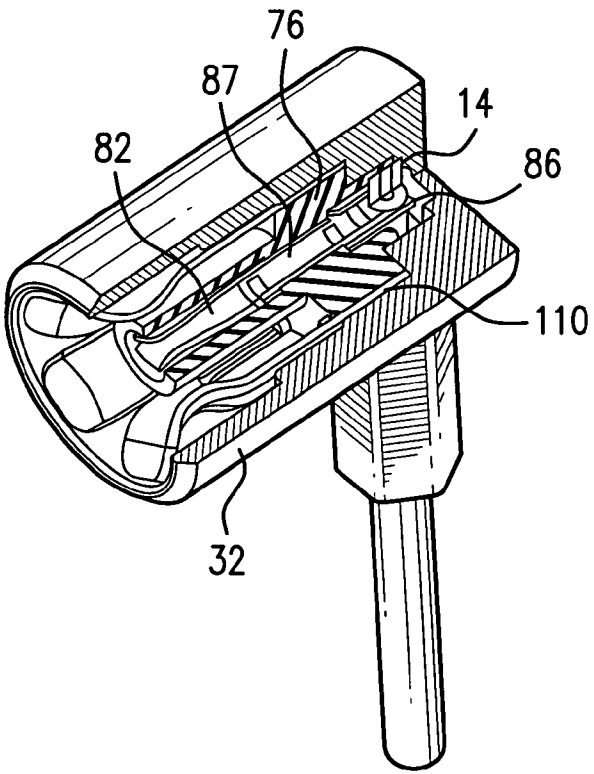
FIG. 12 is a perspective view of the assembled connector with a portion cut away to illustrate the terminal device mated with the cable end.
Figure 11:
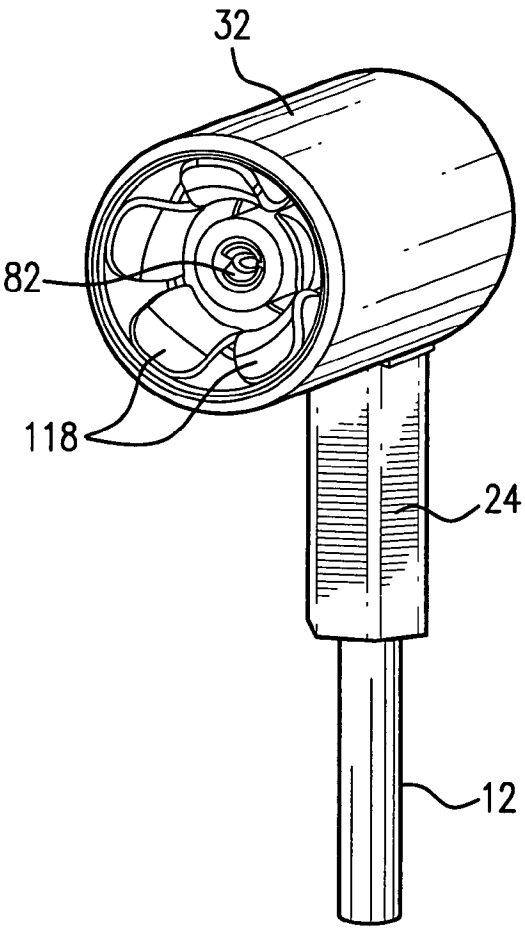
FIG. 11 is a perspective view of the assembled connector.

The assembly of the terminal device 70 with the connector housing 30 is done in an automated process. A tool inserts the ring element 110 of the outer contact 74 through the first chamber 44 after aligning the guide protuberance 122 with the slot 69 (as shown in FIGS. 7 and 8) in chambers 48 and 52. The guide protuberance is received by the slot and then, as illustrated in FIGS. 9 and 10, the ring element is press-fit into the third chamber 52. Simultaneously, the rim element 94 of the dielectric member 76 is guided into the fourth chamber 56 and the insulation displacement blades 86 of the inner terminal 72 cut into the inner insulation layer 20 of the cable end 14 and make mechanical and electrical contact with the center conductive core 22 of the cable 12. The second radial wall 58 in the fourth chamber 56 provides a cable support area that holds the cable end 14 against deflection as the blades slice into the cable. The dome-shaped depression 60 provides a clearance area for the blades, ensuring the blades don't contact the connector housing 30 and short the connection between the core and inner contact terminal. The perspective and cut-away views of FIGS. 11 and 12, respectively, show the completed connector assembly and mated cable.

FIGS. 13–20 illustrate a second embodiment of the invention. In this embodiment, the projection 66 forming the cable stop surface in the fourth chamber 56 of the main connector section 32 is replaced by an extension or extended wall or portion 130 of the rim element 94 of the dielectric member 76. The resistance to electrical shorting depends on the dielectric constant of the material. The air in the space provided by the projection 66 in the first embodiment has a smaller dielectric constant and therefore less resistance to shorting than the plastic of the dielectric member. A higher dielectric constant is needed when a higher dielectric withstanding voltage (DWV) is required to prevent electrical arcing. While this embodiment has the advantage of giving the connector a higher DWV, some modifications to the connector housing, dielectric member and outer contact structure as well as to the assembly process are needed. The same reference numbers are used to refer to components similar to those in the first embodiment.

Figure 14:
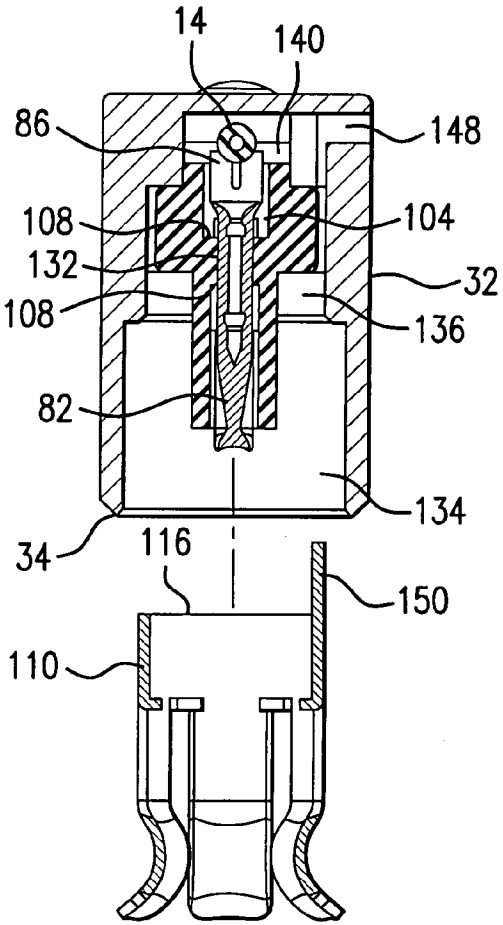
FIG. 14 is a cross-sectional end view of the connector housing and outer contact of the second embodiment.
Figure 13:
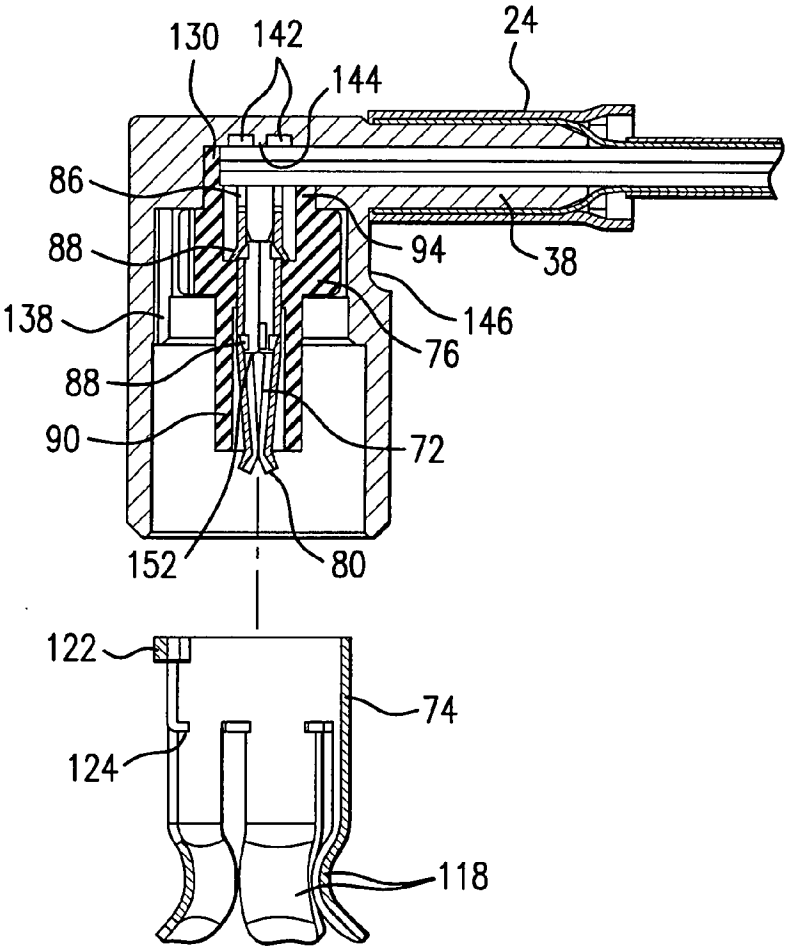
FIG. 13 is a cross-sectional side view of a second embodiment of the connector housing and dielectric member in combination with an outer contact.

Referring to FIGS. 13 and 14, the dielectric member 76 is first assembled with the inner center contact terminal 72. A narrower inner portion 132 of the central passage 104 through the member is shortened in this embodiment such that it is not clamped between the sets of retention barbs 88 of the terminal 72. Initially, the set of retention barbs 88 adjacent the insulation displacement blades 86 contact the associated stop surface 108 of the member. The set of retention barbs 88 adjacent the female terminal part 82 of the terminal remain spaced from the associated stop surface 108 on the opposite end of the shortened narrower inner portion such that the first end 80 of the terminal protrudes from the first segment 90 of the member. This initial position keeps the blades 86 mostly within the confines of the rim element 94 of the member.

The main section 32 of the connector housing is modified to have a first chamber 134 adjacent the terminal mating end 34, a second, intermediate chamber 136 with a longitudinal slot 138 in its inner wall, and a third chamber 140 intersecting with the internal passage 42 through the barrel section 38 of the housing. The third chamber 140 is sized such that the rim segment 94 and its extended portion 130 of the dielectric member 76 can be press-fit into the chamber 140, with the extended portion 130 located across the chamber from the opening 62 of the passage 42. Recesses 142 are formed in a top or end wall 144 of the third chamber 140 directly aligned with the blades 86 of the terminal 72.

Figure 15:
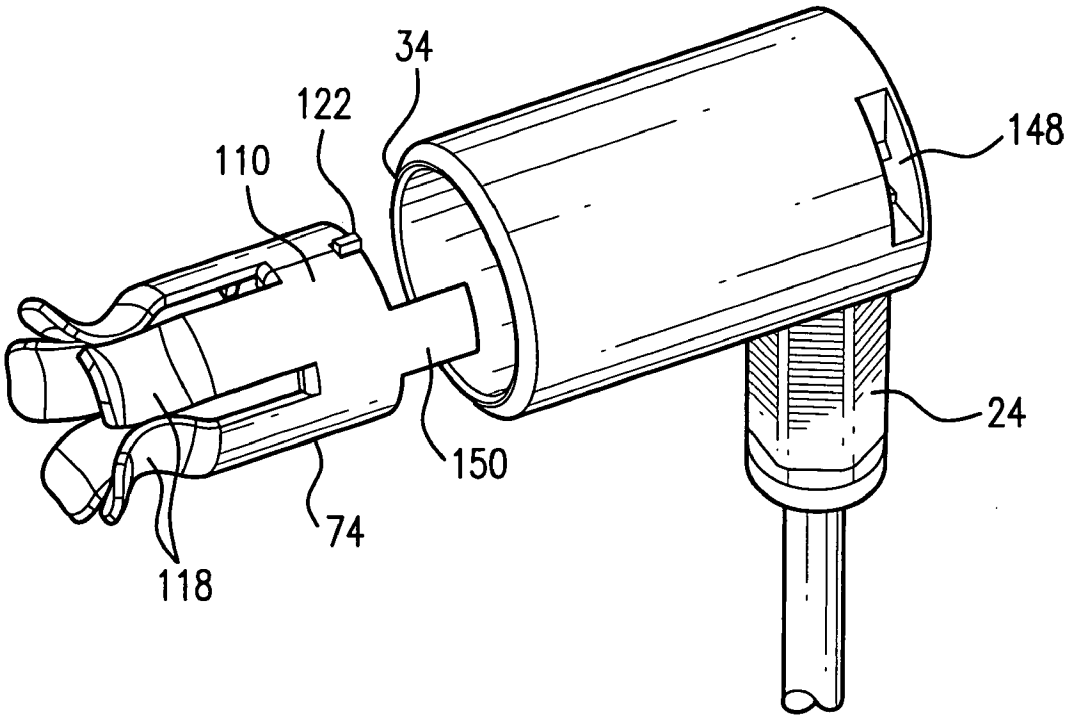
FIG. 15 is a perspective view of the connector housing and outer contact prior to assembly.

The connector housing main section 32 also includes an outer indentation 146, allowing the ferrule 24 to be brought in closer to a longitudinal center-line of the main section and thereby enabling the barrel section 38 to be shorter. This reduces the overall length of the connector. As illustrated in FIGS. 14 and 15, the main section is also modified to include a window 148. The window 148 allows viewing of the cable end 14 and the extended portion 130 of the rim element 94 of the dielectric member 76 within the third chamber 140 prior to assembly of the outer female socket or contact 74 with the connector housing. The window is needed to inspect the positions of the extended dielectric portion 130 and the cable end 12 because, since the dielectric member 76 must now be inserted into the connector housing before the cable end, the final position of the cable end can no longer be viewed through the chambers of the main section 32.

The dielectric member 76 with the inner terminal 72 in the initial position within the member is first inserted into the main section 32 of the connector housing 30. The rim element 94 with its extended portion 130 is press-fit into the third chamber 140, holding the dielectric insert within the housing. The coaxial cable end 14 is then pushed through the barrel section 38 of the housing until it crosses the chamber 140 in the main section and abuts against the extended portion 130. The assembler then looks through the window 148 to make sure the cable end is contacting the dielectric member and electrically isolating the cable core 22 from the connector housing. If the inspection confirms this condition, the ferrule 24 is crimped over the braid 18 onto the barrel section to secure the cable to the connector housing in the correct position.

Figure 17:
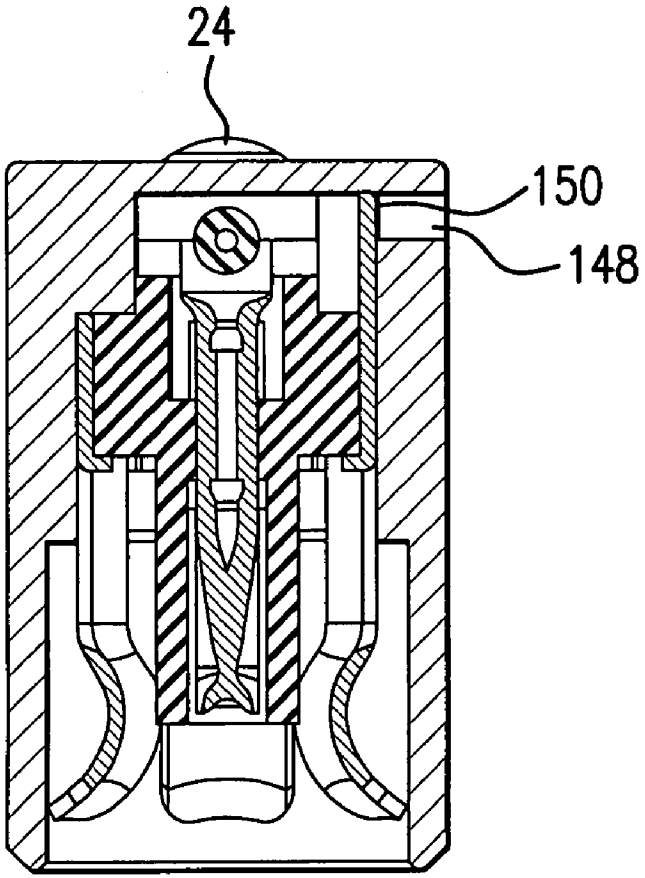
FIG. 17 is a cross-sectional end view of the completed assembly.
Figure 19:
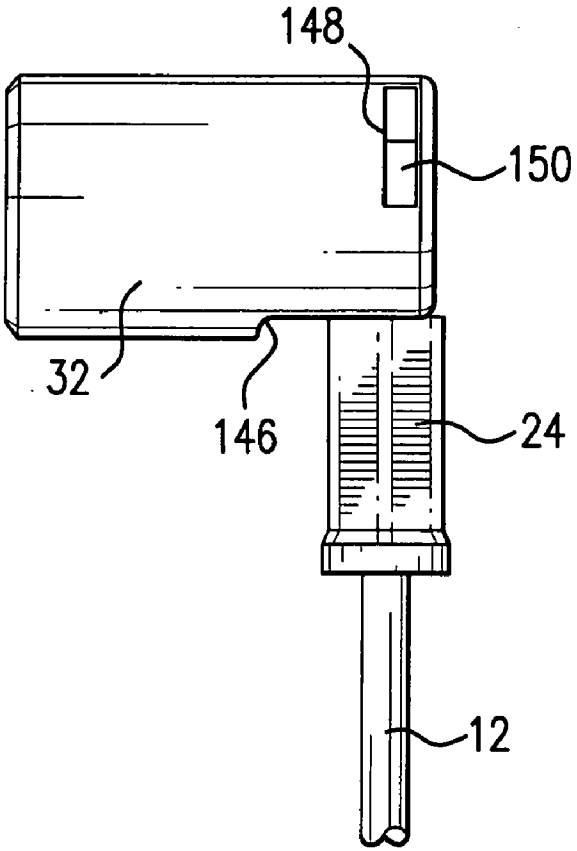
FIG. 19 is a side view of the fully assembled connector and terminated cable.

The outer female socket or contact 74 is generally of the same construction as in the first embodiment except that it includes a relatively short appendage 150 extending from the first end 116 of the ring element 110. The appendage 150 is positioned to close or cover the window 148 when the outer contact 74 is press-fit into the intermediate chamber 136 of the main section 32 after the dielectric member and cable end are assembled in the housing 30. The guide protuberance 122 on the outer contact is aligned with the slot 138 and the tool forces the ring element 110 of the outer contact into the intermediate chamber. The appendage 150 covers the window 148 internally as best illustrated in FIGS. 17 and 19. This provides the connector with good shielding effectiveness for the cable termination.

Figure 16:
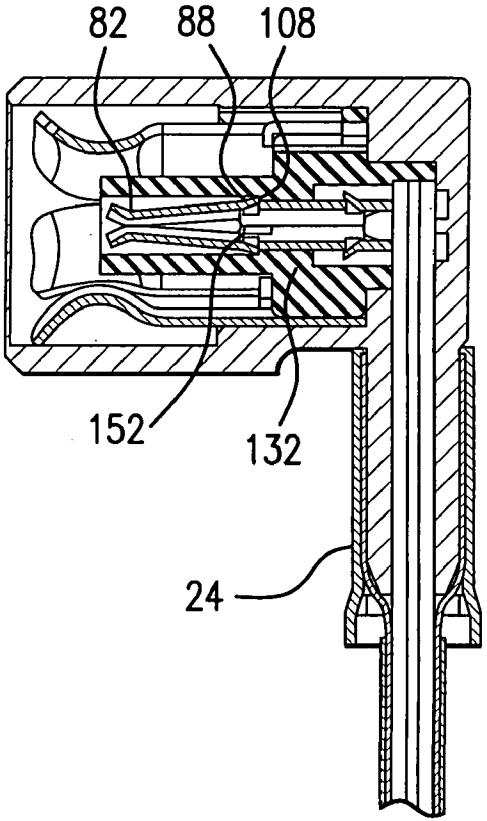
FIG. 16 is cross-sectional side view of the completed assembly.

In the last assembly step, the inner center contact terminal 72 is pressed toward the cable end 14 by exerting force on a push area 152 within the female terminal part 82. The insulation displacement blades 86 cut through the insulation layer 20 of the cable and make electrical contact with the core 22 as the set of retention barbs 88 adjacent the female terminal part abut against the associated stop surface 108 formed by the shortened narrower inner portion 132 of the passage through the dielectric member. This completed assembly is shown in FIGS. 16 and 17. The end wall 144 of the third chamber 140 acts as a support surface to prevent deflection of the cable end. The recesses 142 in the end wall 144 ensure the blades 86 do not contact the connector housing.

In one alternative assembly process, the inner center contact terminal 72 can be forced to terminate the cable prior to press-fitting the outer contact into the main section of the housing. This would have the benefit of allowing viewing of the cable termination by the blades 86 before the window is covered by the outer contact appendage 150.

Figure 18:
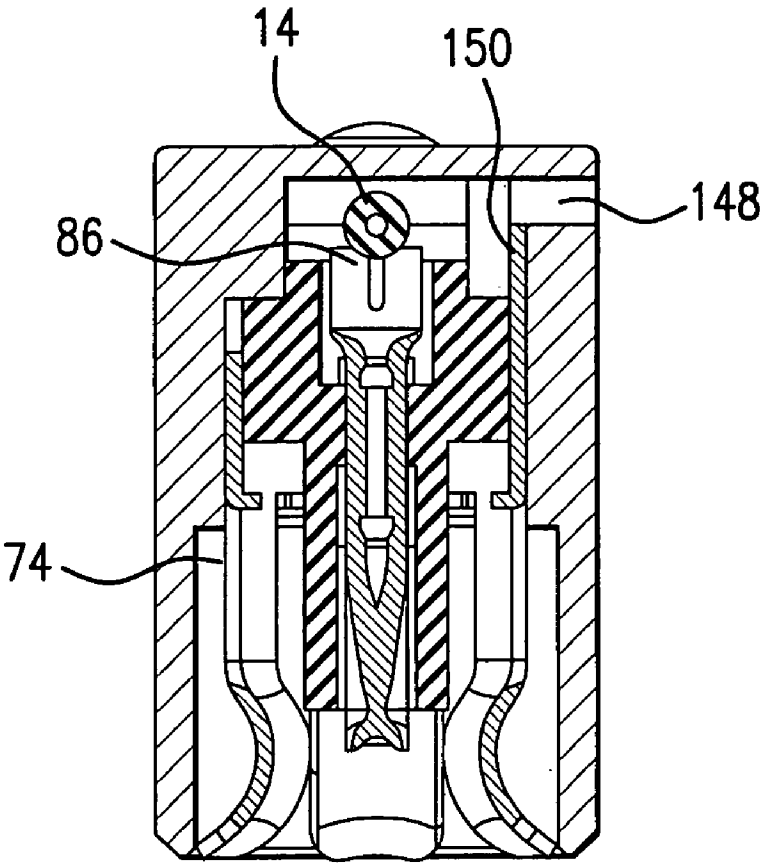
FIG. 18 is a cross-sectional end view of a pre-assembly condition resulting from a modified assembly process.

FIG. 18 shows another alternative assembly process, wherein the outer contact 74 is inserted only to a pre-set position. The appendage 150 does not block the window 148, and the blades 86 of the inner terminal 72 do not cut into the cable end 14. The advantage of this process arises when the assembly of the connector and the termination of the cable are done at different facilities. The pre-assembled connector can be shipped as one piece. A component (the outer contact) does not have to be shipped separately. At the final facility, the cable end 14 can be inserted in the connector housing 30, its position can be inspected through the window 148, and a single stroke of the tool can press the outer contact 74 into the position wherein the appendage 150 covers the window while simultaneously forcing the blades 86 of the inner terminal 72 into electrical contact with the coaxial cable core 22.

Figure 20:
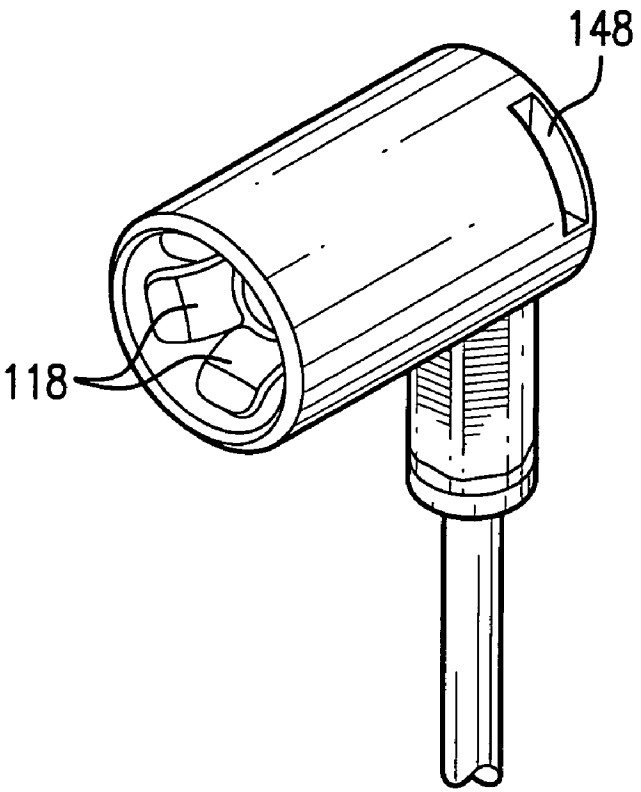
FIG. 20 is a perspective view of the fully assembled connector and terminated cable.

FIGS. 19 and 20 illustrate the completed connector assembly. These views are closer to the actual size of the connector assembly. The assembly in use is received in a plastic, electrically non-conductive outer housing. The ferrule 24 and the outer female socket or contact 74 act as electrical grounds and shields for the inner center contact terminal 72 and the terminated end 14 of the coaxial cable 12.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A coaxial cable connector comprising:

a housing having electrically conductive first and second sections, the second section extending at an angle from the first section and being sized to receive a coaxial cable;

a dielectric member having an inner passage and an outer surface;

a first electrical contact secured within the passage of the member, the first electrical contact having a first part situated within the passage and arranged to engage a mating electrical terminal, and a second part protruding from the member, the second part having insulation displacement surfaces;

a second electrical contact fitted around the outer surface of the member, the second electrical contact being sized to securely fit within the first section of the housing; and a cable stop surface for setting an end portion of the coaxial cable in a predetermined location within the first section, such that the insulation displacement surfaces of the first electrical contact are forced to electrically connect with an inner conductor of the coaxial cable at the predetermined location.

2. The connector of claim 1 wherein the cable stop surface is a projection extending from an inner wall of the first section of the housing.

3. The connector of claim 2 wherein the projection is positioned within the first section of the housing such that only an insulation layer of the cable at the end portion of the cable abuts against the projection.

4. The connector of claim 2 further comprising a space in the first section adjacent the projection for keeping the inner conductor of the cable separated from the first section of the housing.

5. The connector of claim 2 wherein the projection is aligned with an open end of the first section of the housing such that the projection and cable end portion can be viewed through the open end prior to insertion of the dielectric member and first and second contacts into the first section.

6. The connector of claim 1 wherein the cable stop surface is part of the dielectric member.

7. The connector of claim 6 wherein the cable stop surface is an extension from an element of the dielectric member that is press-fit into the first section of the housing.

8. The connector of claim 6 wherein the first electrical contact is movable within the dielectric member between a first, electrically non-connected position and a second position where the insulation displacement surfaces are electrically connected with the inner conductor.

9. The connector of claim 6 further comprising a window in the first section for viewing the end portion of the coaxial cable and the cable stop surface part of the dielectric member.

10. The connector of claim 9 further comprising an appendage extending from the second electrical contact for closing the window when the second electrical contact is securely fit within the first section of the housing.

11. The connector of claim 1 further including a cable support area on the first section of the housing for preventing deflection of the cable end portion as the insulation displacement surfaces of the first electrical contact electrically connect with the cable inner conductor.

12. The connector of claim 1 further including at least one recess in the first housing section for ensuring the insulation displacement surfaces of the first electrical contact do not touch the first housing section after the surfaces electrically connect with the inner conductor of the cable.

13. The connector of claim 1 further comprising a ferrule for securing the cable to the second section of the housing after the end portion of the cable is set in the predetermined location by the cable stop surface.

14. The connector of claim 13 wherein the ferrule is crimped around an outer conductive sheath of the cable and the second section of the housing to electrically connect the second section to the conductive sheath.

15. The connector of claim 13 wherein the first section of the housing includes an outer indentation against which the ferrule abuts, enabling the ferrule to be brought in closer to a longitudinal centerline of the first section.

* * * * *